US007451816B2

(12) United States Patent
Corbett et al.

(10) Patent No.: US 7,451,816 B2
(45) **Date of Patent: *Nov. 18, 2008**

(54) WASHPIPELESS FRAC PACK SYSTEM

(75) Inventors: Thomas G. Corbett, Willis, TX (US); Anderson Da Silva Amaral, Ingá-Niterói (BR); Kenneth MacDonald, Pearland, TX (US); William Triplett, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/900,864

(22) Filed: Sep. 13, 2007

(65) Prior Publication Data

US 2008/0073080 A1 Mar. 27, 2008

Related U.S. Application Data

(63) Continuation of application No. 11/117,982, filed on Apr. 29, 2005, now Pat. No. 7,290,610.

(51) Int. Cl.
*E21B 43/04* (2006.01)

(52) U.S. Cl. ..... 166/278; 166/51; 166/334.4

(58) Field of Classification Search ..... 166/278, 166/51, 334.4, 332.4
See application file for complete search history.

(56) References Cited

U.S. PATENT DOCUMENTS

| | | | | |
|---|---|---|---|---|
| 6,981,551 | B2 * | 1/2006 | Turner et al. | 166/278 |
| 6,983,795 | B2 * | 1/2006 | Zuklic et al. | 166/51 |
| 7,124,824 | B2 * | 10/2006 | Turner et al. | 166/374 |
| 7,290,610 | B2 * | 11/2007 | Corbett et al. | 166/278 |
| 2006/0108115 | A1 * | 5/2006 | Johnson | 166/278 |

* cited by examiner

*Primary Examiner*—William P Neuder
(74) *Attorney, Agent, or Firm*—Shawn Hunter

(57) ABSTRACT

A well packing system and method for operating a well packing system wherein an isolation string assembly has a lower circulation valve with lateral flow ports that are operated to an open position without the use of shifters on a wash pipe. The isolation string assembly is incorporated into a well packing assembly within a wellbore and includes an upper sleeve tool that provides selective production of fluids through the frac pack assembly. In addition, the isolation string includes a lower circulation valve having a sliding sleeve that is shiftable from an open position to a closed position upon receipt of a suitable pressure differential. This configuration is particularly valuable for permitting monitoring of pressure or other conditions in the annulus of the wellbore portion being packed during packing operations. Further, the lower circulation valve tool can be used to selectively allow fluid returns during the packing operation.

15 Claims, 4 Drawing Sheets

WASHPIPELESS FRAC PACK SYSTEM

This application is a continuation of U.S. patent application Ser. No. 11/117,982 filed Apr. 29, 2005, now U.S. Pat. No. 7,290,610.

BACKGROUND OF THE INVENTION

1. Field of the Invention

The invention relates generally to isolation assemblies used in fracturing/gravel packing, or "frac pack," systems.

2. Description of the Related Art

Because hydrocarbon production wells are often drilled into unconsolidated formations, sand and fines from those formations will tend to enter the production tubing along with the produced fluids. To prevent this, it has become relatively standard practice to run a fracturing and gravel packing treatment, commonly referred to as a "frac pack," within the wellbore prior to production. During the fracturing treatment, the production zone is stimulated by creating fractures in the formation rock and flowing proppant material into the fractures to keep the fractures from closing. During the gravel packing operation the annulus surrounding the screen assembly is filled with gravel or another granulated material. This material forms a barrier around the screen and provides a filter to help prevent sand and fines from the formation from entering the production tubing string.

A conventional frac pack system includes a screen assembly that is placed in the wellbore near the unconsolidated formation. The screen assembly radially surrounds a wash pipe, and both the screen assembly and wash pipe are connected, at their upper ends, to a service tool. The usual service tool includes a production packer and a cross-over tool, which are connected to a work string that extends downwardly from the surface. The work string is used to position the screen assembly in the wellbore. Packers provide fluid sealing. The frac pack system can be placed into a "squeeze" configuration, wherein no fluids return to the surface. In this configuration, fracturing fluid is passed through the cross-over tool, into the annulus and then into the formation. Alternately, the frac pack system can be placed into a "circulation" position to allow flow through the wash pipe back to the surface. Gravel packing slurry is then flowed in through the cross-over tool to gravel pack the annulus around the screen assembly. When gravel packing is completed, the service tool is detached from the screen assembly and withdrawn from the wellbore, leaving the gravel packed screen assembly and packer in place. Further details concerning the construction and operation of frac pack systems in general are provided in U.S. Pat. No. 6,789,623 issued to Hill, Jr. et al. This patent is owned by the assignee of the present invention and is incorporated herein by reference.

Traditional frac pack systems have utilized an isolation string that is installed inside the production screen at the surface and is controlled in the wellbore by an inner service string. Typically, the isolation string has two or more sliding sleeve valves that are shifted between open and closed positions mechanically by a shifting tool carried on the wash pipe. One problem with the use of wash pipe-based mechanical shifters is that the wash pipe is relatively weak and provides a point of potential failure where it passes through the isolation string. Additionally, it is time consuming, and thus costly, to have to make up a string of wash pipe to operate the sleeve valves.

One alternative to the use of wash pipe to operate the sleeve valves in the isolation string is described in U.S. Pat. No. 6,397,949 issued to Walker et al. In Walker's system, the isolation string uses one or more pressure activated control valves that are moveable between three functional positions: closed-locked, closed-unlocked, and open-unlocked. It is an intended feature of Walker's system to ensure simultaneous opening of all of the valves within the isolation string. Walker contends that, if all the valves did not open at once, a single open valve would eliminate the pressure differential needed to open all of the other sleeves. Thus, Walker's system does not appear to permit conditions of the gravel packing operation to be monitored through the flowbore during the gravel packing operation when all the valves are closed.

Another wash pipe-less system is described in U.S. Patent Publication No. US 2003/0178198 A1 (Turner et al.). In the described system, the isolation string includes a pressure activated control valve and an object activated control valve. These control valves are each operated in a different manner. The object activated control valve is operated using a ball or other object that is dropped into the flowbore. The pressure activated control valve (PACV) is initially run into the wellbore in a closed-locked configuration. When access to a nearby production zone is desired, a predetermined pressure differential is applied between the casing annulus and the internal annulus to shift an inner sleeve in the PACV to a closed-unlocked configuration. Subsequently, the PACV is moved to an open-unlocked configuration by a reduction in fluid pressure.

The present invention addresses the problems of the prior art.

SUMMARY OF THE INVENTION

The invention provides an improved frac pack system and method for operating a frac pack system. In further aspects, the invention provides an improved isolation string assembly having a lower circulation valve with lateral flow ports that are operated to an open position without the use of shifters on a wash pipe. In a preferred embodiment, the isolation string assembly is incorporated into a frac pack assembly within a wellbore and includes an upper sleeve tool that provides selective circulation of fluids through the frac pack assembly. In addition, the isolation string includes a lower circulation valve having a sliding sleeve that is shiftable from an open position to a closed position upon receipt of a suitable pressure differential. This configuration is particularly valuable for permitting monitoring of pressure or other conditions in the annulus of the wellbore portion being packed during frac pack operations. Further, the lower circulation valve tool can be used to selectively allow fluid returns prior to production occurring.

In operation, the frac pack system with isolation string assembly is placed into a wellbore and landed within a packer. A production packer on the frac pack system is set and tested. The frac pack assembly is placed into the squeeze configuration and, thereafter, a circulating configuration. When circulation is completed, the annulus above the production packer is evacuated. The setting tool portion of the frac pack system is then partially withdrawn so that reverse circulation can occur. Next, the lower circulating valve is shifted to its closed position. The setting tool portion of the frac pack system is withdrawn and a standard production tubing string is run into the screen assembly. The upper sleeve tool is then shifted to an open position so that production can occur.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
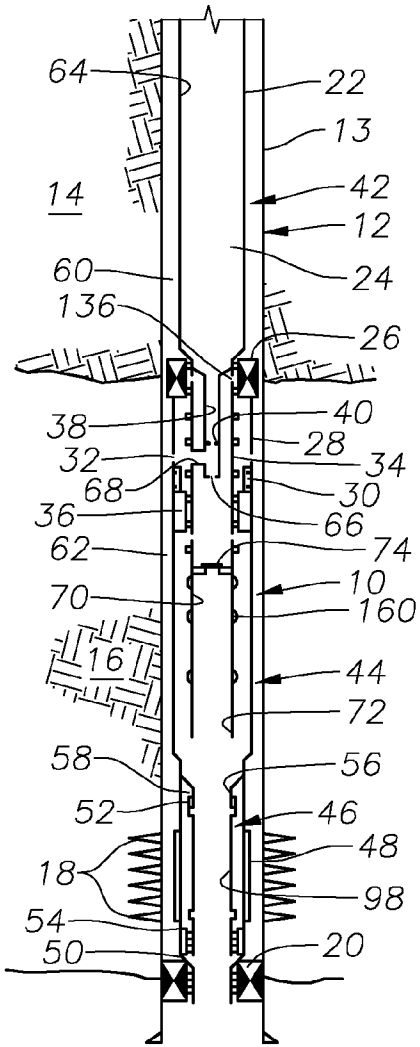
FIG. 1 is a side, cross-sectional view of an exemplary frac pack system constructed in accordance with the present invention with the service tool portion being run into a wellbore.

FIGS. 1-9 depict an exemplary frac pack system, generally shown at 10, that is being operated within a wellbore 12. The wellbore 12 with casing 13 is disposed within the earth 14 through a hydrocarbon-bearing formation 16 from which it is desired to produce. Perforations 18 penetrate the surrounding formation 16. A packer 20 has previously been run and set within the wellbore 12 at the lower end of the formation 16. In FIG. 1, the frac pack system 10 is being lowered into the wellbore 12 on a work string 22 to be landed into the packer 20. The frac pack system 10 includes a setting tool of a type known in the art and shown schematically at 24. A production packer 26 is affixed to the lower end of the setting tool 24. The production packer 26 may be of any known type suitable for use in a frac pack application. One suitable packer for use as the production packer 26 is the model "SC-2" packer that is available commercially from Baker Oil Tools of Houston, Tex. During run-in, as illustrated in FIG. 1, the production packer 26 is in an unset position.

Below the production packer 26 is a blank pipe 28 having an interior axially sliding sleeve 30 for selectively opening lateral fluid ports 32 in the blank pipe 28. A gravel pack cross-over tool 34 is located radially inside of the blank pipe 28 and carries a shifter 160 for opening or closing the sliding sleeve device 30. The cross-over tool 34 includes a reduced diameter fluid flow path 38 with a ball seat 40 within.

The setting tool 24, cross-over tool 34, reduced diameter flow path 38, and ball seat 40 collectively form the service tool portion 42 of the frac pack system 10. The service tool portion 42 is used to run a solids placement portion 44 of the system 10 into the wellbore 12, and land it into the lower packer 20. The solids placement portion 44 of the frac pack system 10 includes the blank pipe 28, sleeve 30, cross-over tool 34, and sliding sleeve shifter 160. Additionally, the solids placement portion 44 includes an isolation string 46 with a radially surrounding screen 48. Secured to both the isolation string 46 and the screen 48 is a landing nipple 50 that is shaped and sized to seat into lower packer 20.

The isolation string 46 includes an upper sleeve tool 52 and a lower circulation valve 54. The upper sleeve tool 52 is preferably a CMP™ Defender non-elastomeric sliding sleeve (product family no. H81082), which is available commercially from Baker Oil Tools of Houston, Tex. The upper sleeve tool 52 is a sliding sleeve valve assembly that allows selective fluid communication between its interior flowbore 56 and the annulus 58 that is formed between the isolation string 46 and the surrounding screen 48. It is noted that the upper sleeve tool 52 has three operating positions: closed-locked, closed-unlocked, and open-unlocked. When run into the wellbore 12, the upper sleeve tool 52 is in a closed-locked position.

A number of annuli and flowpaths are also defined within and by the frac pack system 10. An upper annulus 60 is defined between the wellbore casing 13 and work string 22 above the production packer 26, while a lower annulus 62 is defined between the casing 13 and blank pipe 28 in between packers 20 and 26. An upper axial flowbore 64 is defined within the work string 22 and merges into the reduced diameter flowpath 38. The lower end of the reduced diameter flowpath 38 has a lower axial fluid opening 66 and a lateral fluid pathway 68. A central flowbore 70 is defined within the cross-over tool 34 and has a lower opening 72.

A flapper-type check valve 74 is retained within the central flowbore 70. The check valve 74 is of a type known in the art for allowing one-way flow within a flowbore. Typically, the valve 74 has a hinged flapper member that is biased to a closed position, as is known in the art. When closed, the flapper valve 74 will block fluid from flowing downwardly through the flowbore 70.

Figure 10:
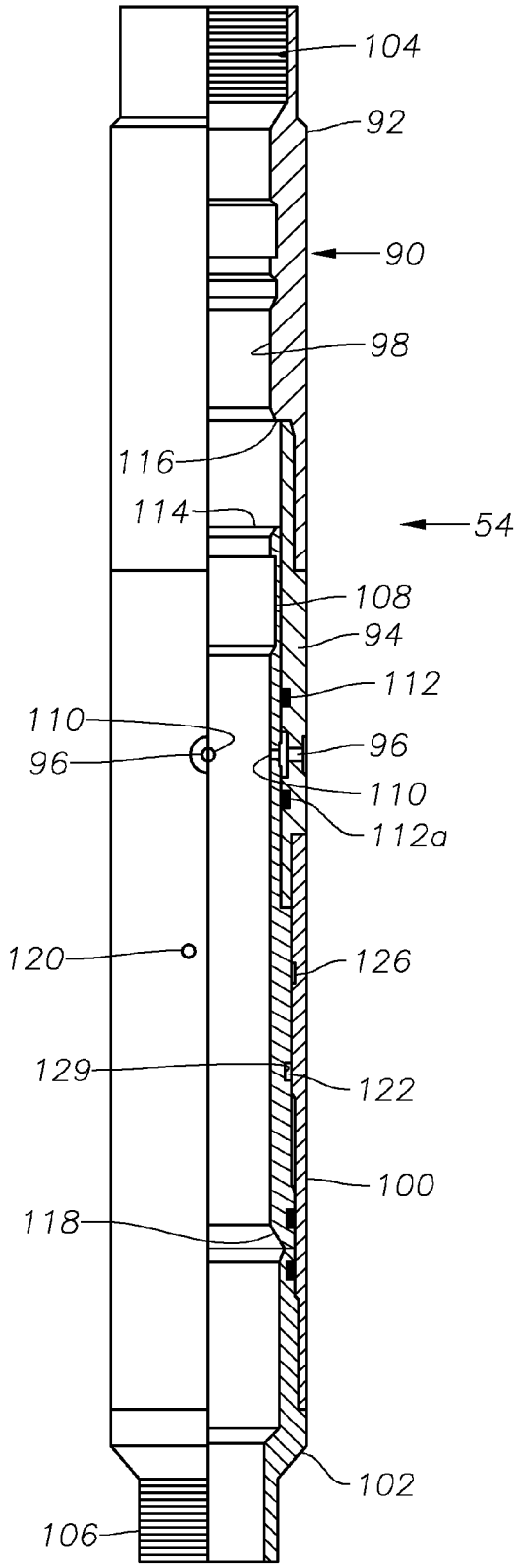
FIG. 10 is a side, partial cross-sectional view of an exemplary lower circulation valve used in the frac pack system shown in FIGS. 1-9.

An exemplary lower circulation valve 54 is shown in detail in FIG. 10. The lower circulation valve 54 includes a valve body 90 that is made up of a top sub 92 that is threadedly connected to a tubular upper body 94. The upper body 94 contains a plurality of restricted flow area lateral metering ports 96 that permit fluid communication between the lower annulus 62 and the flowbore 98 that is defined within the valve body 90 and the isolation string 46. The metering ports 96 are sized to permit a predetermined amount of fluid flow through them. The lower end of the upper body 94 is threadedly connected to a lower body 100 which, in turn is connected to bottom sub 102. The top sub 92 and bottom sub 102 have threaded end connections 104, 106, respectively, for interconnection with other portions of the isolation string 46. Radially within the valve body 90 is a sleeve member 108 that is axially moveable within the valve body 90 between an open position (depicted in FIG. 10) and a closed position. The sleeve member 108 has lateral fluid ports 110 that are aligned with the metering ports 96 when the sleeve member 108 is in the open position. Annular fluid seals 112, **112*a* are located on each axial side of the ports 110. The sleeve member 108 has an upper axial end 114 that is formed to engage a stop shoulder 116 formed on the interior of the valve body 90 when the sleeve member 108 is moved to its closed position. In the closed position, the sleeve member 108 is shifted axially upwardly so that the upper axial end 114 engages the shoulder 116. In this closed position, the interior ports 110 are not aligned with the metering ports 96, and the lower seal 112*a* is located between the metering ports 96 and the ports 110 to prevent fluid communication between them. The lower end of the sleeve member 108 presents an annular fluid pressure receiving area 118**.

In a preferred embodiment, the lower circulating valve 54 has a frangible shear member 120, such as a shear screw, that releasably secures the sleeve member 108 in the open position shown in FIG. 10. Additionally, a radially outwardly biased C-ring 122 is located in an exterior groove 124 on the sleeve member 108. The valve body 90 includes an interior radial recess 126.

The lower circulating valve 54 has two positions: open and closed-locked. The lower circulating valve 54 is run into the wellbore 12 in the open position, which is depicted in FIG. 10. The open position allows monitoring of pressure and other conditions within the lower annulus 62 during a frac pack operation. As will be described in further detail shortly, circulation may also be conducted through the circulation valve 54 during the frac pack operation. The valve 54 is then closed prior to conducting primary production through the upper sleeve tool 52 during later production operations. When the sleeve member 108 is moved to its closed position, fluid pressure is increased within the flowbore 98 so that the increased internal pressure bears upon the pressure receiving area 118. The valve 54 is, of course, open at this point so that fluid may be communicated through the aligned ports 110, 96 to the lower annulus 62. However, because the ports 96 are metering ports with a restricted flow area, they only permit a certain amount of fluid to pass through at a given time. Therefore, increasing the fluid pressure within the flowbore 98 at a great enough rate will still produce a sufficiently high pressure differential between the flowbore 98 and lower annulus 62 to shear the shear member 120 and urge the sleeve member 108 upwardly. Pumping into the flowbore 98 at a sufficiently high rate (i.e., 4 barrels per minute or so) will build sufficient pressure differential to shift the sleeve member 108. The C-ring 122 will expand radially outwardly and partially into the recess 126, there by locking the valve 54 into its closed position.

Figure 2:
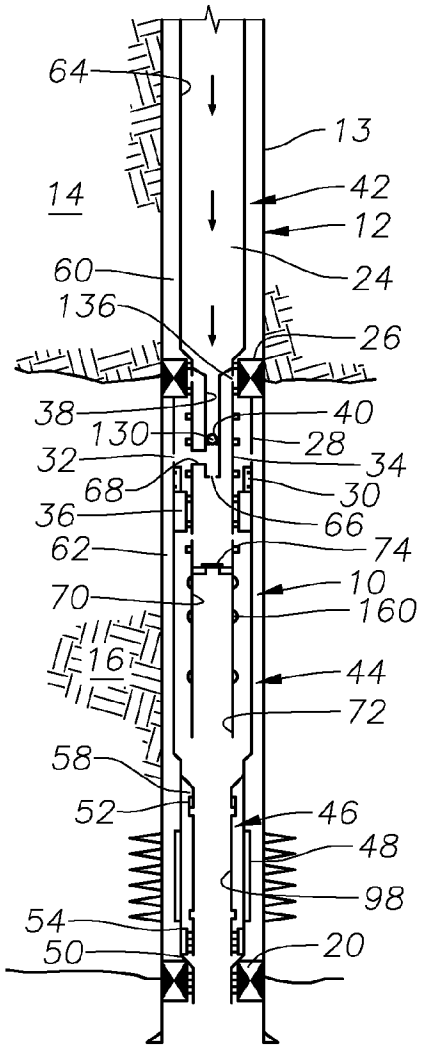
FIG. 2 is a side, cross-sectional view of the frac pack system shown in FIG. 1, now with the production packer having been set.

Referring once again to FIGS. 1-9, overall operation of the frac pack system 10 is now described. In FIG. 1, the frac pack system 10 is being run into the wellbore 12 and the landing nipple 50 is landed into the lower packer 20. In FIG. 2, the upper production packer 26 has been set by dropping a ball 130 into reduced diameter bore 38 to land within the ball seat 40. Increased fluid pressure behind the ball 130 will set the upper packer 26.

Figure 3:
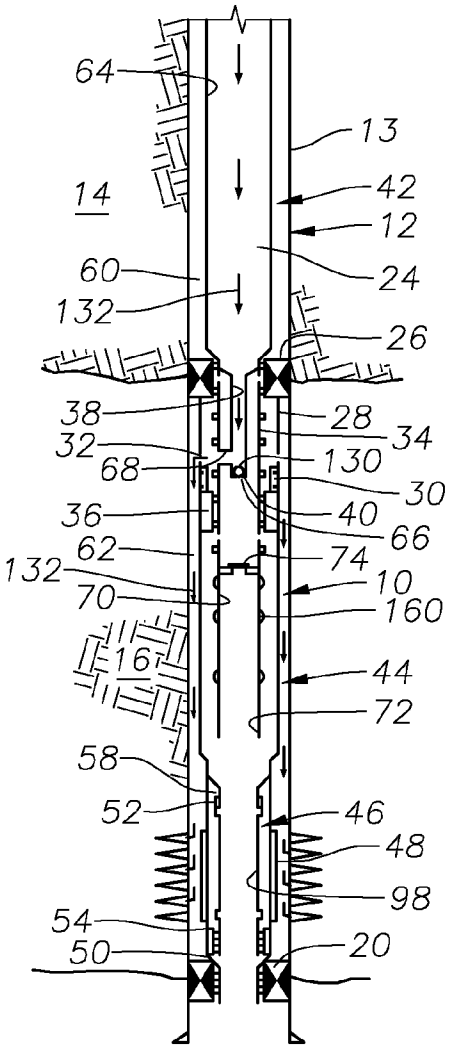
FIG. 3 is a side, cross-sectional view of the frac pack system shown in FIG. 1, now in the squeeze position.

In FIG. 3, the frac pack system 10 has been placed into the squeeze position lateral fluid pathway 68 has been opened above the ball 130 and permits fracturing fluid or a solids-containing fluid from the surface to pass from the flowbore 64 outwardly and into the lower annulus 62, as depicted by arrows 132. The pumped fluid or slurry enters the lower annulus and perforations 48.

Figure 4:
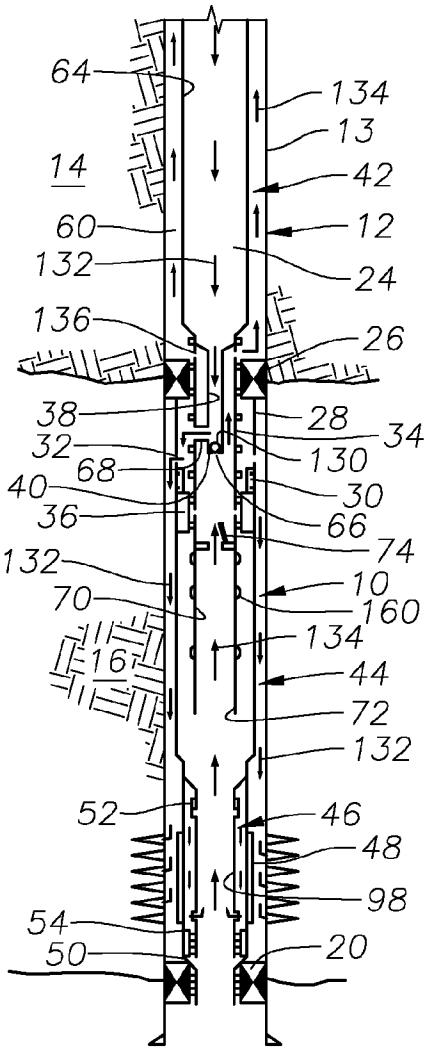
FIG. 4 is a side, cross-sectional view of the frac pack system shown in FIG. 1, now in a circulating configuration.
Figure 9:
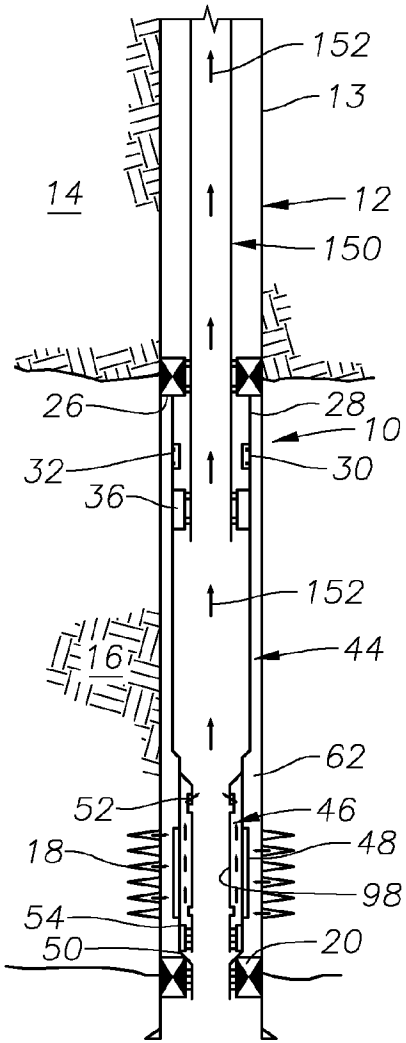
FIG. 9 is a side, cross-sectional view of the frac pack system shown in FIG. 1, now with production occurring.
Figure 8:
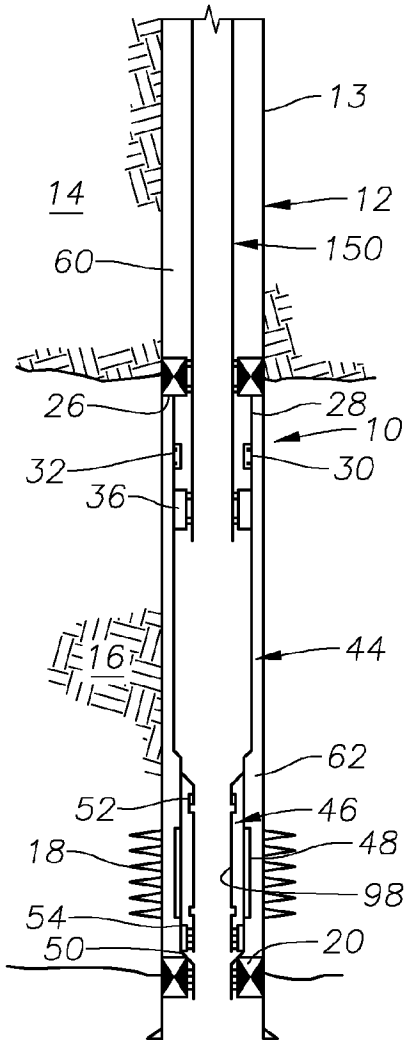
FIG. 8 is a side, cross-sectional view of the frac pack system shown in FIG. 1, now with an upper completion string having been run.

In FIG. 4, the frac pack system 10 has been placed in a circulating configuration by opening the flapper valve 74 to permit fluid returns to the surface via the lower circulation valve 54 into flowbores 98 and 70 as shown by arrows 134. The fluid returns 134 exit the cross-over tool 34 via lateral openings 136 and enter the upper annulus 60 where they can flow to the surface of the well for extraction. Fluid within the lower annulus 62 can enter the isolation string 46 via the aligned ports 110, 96 of the lower circulation valve 54. The upper annulus 60 can also be isolated using surface valves as is known in the art to prevent extraction of fluids. With the upper annulus 60 isolated, conditions within the lower wellbore 62 surrounding the screen 48 and proximate the perforations 18 can be monitored by measurements of the upper annulus 60 pressure from the surface of the well or, alternatively, by placing a suitable condition-measuring sensor, of a type known in the art, into the lower flowbore 98 of the isolation string 46 itself.

Figure 5:
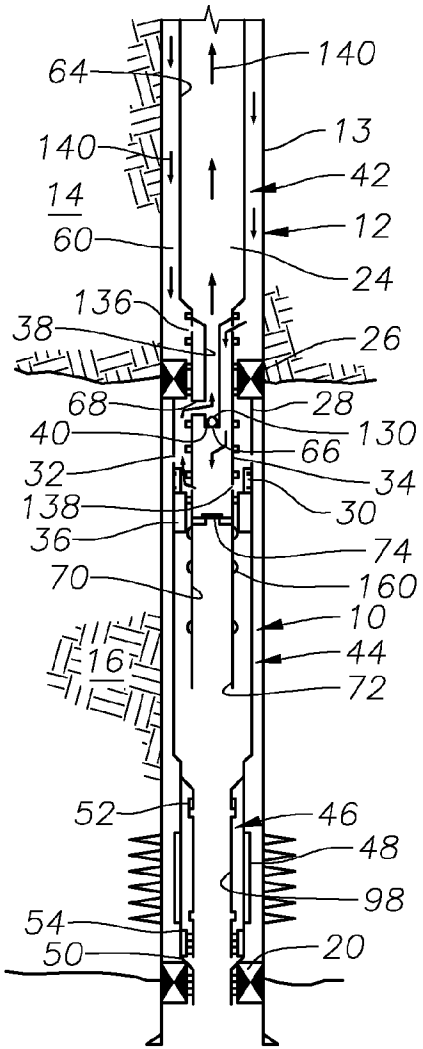
FIG. 5 is a side, cross-sectional view of the frac pack system shown in FIG. 1, now in an evacuation configuration.

Referring now to FIG. 5, the frac pack system 10 is now placed into an evacuation configuration to help clear the cross-over tool 34. To accomplish this, the setting tool portion 24 of the frac pack system 10 is shifted upward to expose lateral ports 138 in the cross-over tool 34. The flapper valve 74 is closed. Cleaning fluid, indicated by arrows 140, is circulated down the upper annulus 60 and enters the cross-over tool 34 via lateral openings 136. From there, the cleaning fluid 140 flows outwardly through ports 138 and returns upwardly through fluid pathway 68 to the reduced diameter flowpath 38. From there, it returns to the surface via flowbore 64.

Figure 6:
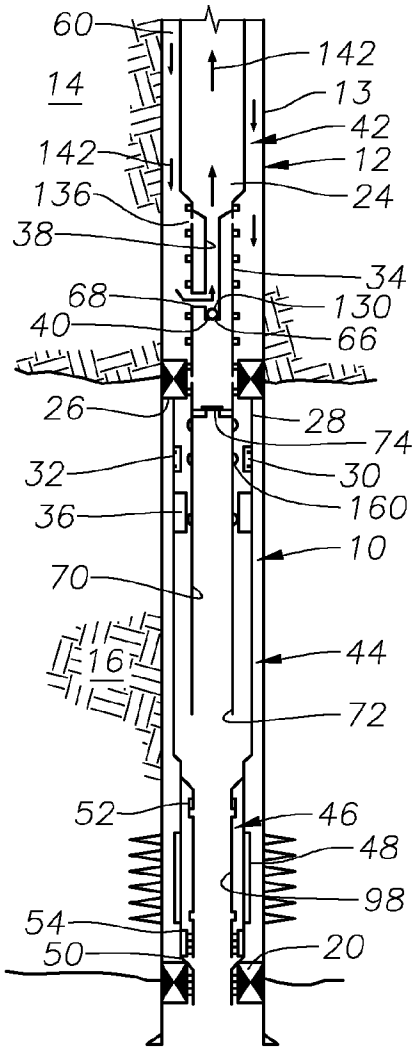
FIG. 6 is a side, cross-sectional view of the frac pack system shown in FIG. 1, now in a reverse circulation configuration.

FIG. 6 depicts the frac pack system 10 in a reverse circulation configuration wherein the setting tool portion 24 of the frac pack system 10 has been raised within the wellbore 12 so that the fluid pathway 68 is located above the production packer 20. Fluid, indicated by arrows 142, is flowed downwardly through the upper annulus 60 and then flows radially inwardly through the fluid pathway 68 to the flowbore 64 wherein it can return to the surface.

Figure 7:
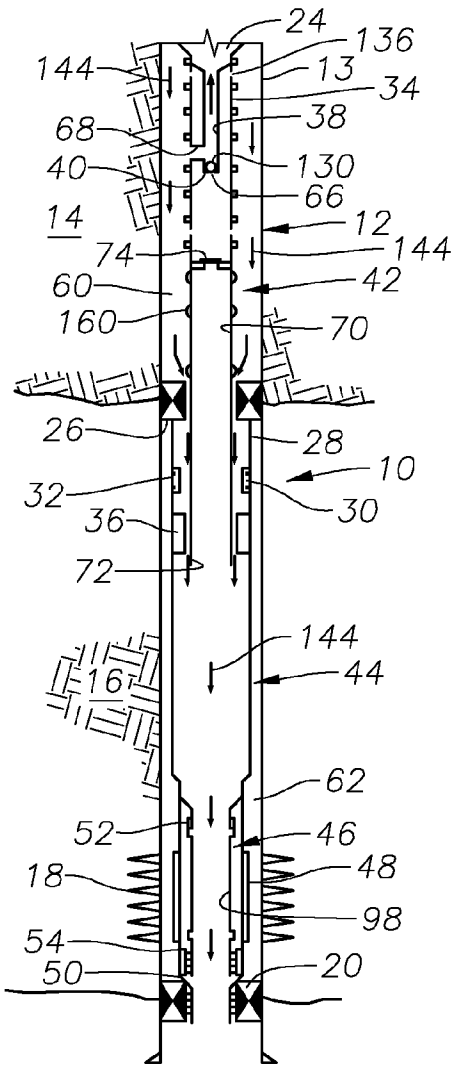
FIG. 7 is a side, cross-sectional view of the frac pack system shown in FIG. 1, now with the lower circulation valve of the isolation string in the process of being closed.

FIG. 7 illustrates the step of closing the lower circulating valve 54. As shown by the arrows 144, pressurized fluid is pumped down the upper annulus 60, through the blank pipe 28 and into the flowbore 98 of the isolation string 46. This pressure increase will, as described previously, cause the sleeve member 108 of the lower circulating valve 54 to be shifted axially upwardly to its closed position, thereby closing off fluid flow through the lower circulating valve 54 from the lower annulus 62 into the flowbore 98. Hydrostatic pressure is maintained within the flowbore 98 and reservoir 16 is effectively isolated from flow while the service tool portion 42 of the frac pack system 10 is withdrawn from the wellbore 12 and a standard production tubing string 150 (see FIG. 8) is run into the wellbore 12 to become seated within production packer 26 and seal bore 36.

Once the production tubing string 150 has been run, fluid pressure is applied within the wellbore 12 so that the upper sleeve tool 52 can move from its closed-locked position to a closed-unlocked position. As fluid pressure within the wellbore 12 is reduced, the upper sleeve tool 52 can move from its closed-unlocked position to an open-unlocked position thereby allowing production fluid to flow from the perforations 18 through placed gravel (not shown) in the lower annulus 62 and screen 48 and further through the upper sleeve tool 52 to interior flowbore 98. From there, the production fluid, indicated by arrows 152, flows upwardly through the production tubing 150 to the surface of the well.

Those of skill in the art will recognize that numerous modifications and changes may be made to the exemplary designs and embodiments described herein and that the invention is limited only by the claims that follow and any equivalents thereof.

What is claimed is:

1. An isolation string for providing selective communication of fluid between an interior flowbore of the isolation string and a wellbore portion surrounding the isolation string, the isolation string being disposed radially within a screen in a well packing system, defining an axial flowbore within and comprising:

a first valve for selective communication of fluid between the flowbore and the wellbore portion, the first valve being moveable between an open position and a closed position; and a second valve for selective communication of fluid between the flowbore and the wellbore portion, the second valve being moveable between an open position and a closed position, and wherein the second valve is in the open position during well packing operations and is moved to the closed position for production through the isolation string.

2. The isolation string of claim 1 wherein the second valve comprises a sliding sleeve valve having:

a valve body;

a flow metering device disposed within the valve body for transmitting a predetermined rate of fluid between the flowbore and the wellbore portion; and a sleeve member disposed radially within the valve body and axially moveable therewithin, the sleeve member being moveable between an open position, wherein fluid flow is permitted through the metering device, and a closed position, wherein fluid flow is blocked through the metering device.

3. The isolation string of claim 2 further comprising a device for locking the sleeve member in the closed position.

4. The isolation string of claim 2 further comprising a frangible shear member for releasably securing the sleeve member in the open position.

5. A well packing system for placing solids in a wellbore and subsequently producing production fluid from the wellbore, the well packing system comprising:

a service tool portion;

a solids placement portion having:

a screen;

an isolation string having an interior flowbore and providing selective communication of fluid between the interior flowbore and the wellbore surrounding the isolation string, the isolation string comprising:

a) a first valve for selective communication of fluid between the flowbore and the wellbore portion, the first valve being moveable between a closed position and an open position; and b) a second valve for selective communication of fluid between the flowbore and the wellbore portion, the second valve being moveable between an open and a closed position, and wherein the second valve is in the open position during well packing operations and is moved to the closed position for production through the isolation string.

6. The well packing system of claim 5 wherein the second valve of the isolation string is actuated between open and closed positions by varying fluid pressure within the flowbore of the isolation string.

7. The well packing system of claim 5 wherein the first and second valves of the isolation string are actuated between positions by varying fluid pressure within the flowbore of the isolation string.

8. A method of conducting a well packing operation within a wellbore, comprising the steps of:

disposing a service tool portion and solids placement portion within a wellbore, the solids placements portion having an isolation string with a flowbore defined therewithin, the isolation string further comprising:

a first valve that is moveable between an open position and a closed position;

a second valve that is moveable between an open position wherein fluid communication is provided between the wellbore and the flowbore and a closed position wherein fluid communication is blocked between the wellbore and the flowbore;

flowing a solids-containing packing fluid into the wellbore;

moving the second valve to its closed position; and thereafter, producing production fluid from the wellbore through the first valve of the isolation string.

9. The method of claim 8 further comprising the step of monitoring a wellbore condition during the step of flowing a solids-containing packing fluid into the wellbore.

10. The method of claim 9 wherein the second valve is in an open position during the step of flowing a solids-containing packing fluid into the wellbore so that monitoring of a wellbore condition may be conducted.

11. The method of claim 10 wherein the second valve is actuated between its open and closed positions by varying fluid pressure within the flowbore of the isolation string.

12. The method of claim 10 further comprising the step of circulating fluid returns through the isolation string.

13. The method of claim 8 wherein the second valve comprises a valve body;

a flow metering device disposed within the valve body for transmitting a predetermined rate of fluid between the flowbore and the wellbore portion; and a sleeve member disposed radially within the valve body and axially moveable therewithin, the sleeve member being moveable between an open position, wherein fluid flow is permitted through the metering device, and a closed position, wherein fluid flow is blocked through the metering device.

14. The method of claim 13 further comprising the step of locking the sleeve member in the closed position.

15. The method of claim 13 further comprising the step of shearing a frangible member to release the sleeve member from the open position.

* * * * *